US011193477B2

(12) United States Patent
Asai

(10) Patent No.: US 11,193,477 B2
(45) Date of Patent: Dec. 7, 2021

(54) AIR COMPRESSOR

(71) Applicant: MAX CO., LTD., Tokyo (JP)

(72) Inventor: Masatoshi Asai, Tokyo (JP)

(73) Assignee: MAX CO., LTD., Tokyo (JP)

( * ) Notice: Subject to any disclaimer, the term of this patent is extended or adjusted under 35 U.S.C. 154(b) by 293 days.

(21) Appl. No.: 15/801,516

(22) Filed: Nov. 2, 2017

(65) Prior Publication Data

US 2018/0119687 A1 May 3, 2018

(30) Foreign Application Priority Data

Nov. 3, 2016 (JP) ..... JP2016-215742

(51) Int. Cl.

| | |
|---|---|
| ***F04B 41/02*** | (2006.01) |
| ***F04B 35/06*** | (2006.01) |
| ***F04B 25/00*** | (2006.01) |
| ***F04B 35/04*** | (2006.01) |
| ***F04B 27/00*** | (2006.01) |

(52) U.S. Cl.

CPC ..... *F04B 41/02* (2013.01); *F04B 25/005* (2013.01); *F04B 27/005* (2013.01); *F04B 35/04* (2013.01); *F04B 35/06* (2013.01)

(58) Field of Classification Search

CPC ..... F04B 41/02; F04B 35/06; F04B 35/04; F04B 25/005; F04B 27/005; F04B 53/001; F04B 53/16; F04B 23/02; F04B 23/025; F04B 23/028; F04B 23/026; F16M 3/00; F16M 2200/028

See application file for complete search history.

(56) References Cited

U.S. PATENT DOCUMENTS

| | | | | |
|---|---|---|---|---|
| 6,485,269 | B1 * | 11/2002 | Matthew | F04B 35/04 417/234 |
| 8,814,535 | B2 * | 8/2014 | Etter | F04B 41/02 417/234 |
| 2006/0093489 | A1 * | 5/2006 | Hernandez | F04B 35/06 417/234 |
| 2010/0290929 | A1 * | 11/2010 | Ohi | F04B 35/06 417/360 |

(Continued)

FOREIGN PATENT DOCUMENTS

| | | |
|---|---|---|
| JP | 2000-249071 A | 9/2000 |
| JP | 2012-159030 A | 8/2012 |

(Continued)

OTHER PUBLICATIONS

Extended European Search Report dated Apr. 11, 2018 in corresponding European patent application 17199828.9 (7 pages).

(Continued)

*Primary Examiner* — Essama Omgba
*Assistant Examiner* — Christopher J Brunjes
(74) *Attorney, Agent, or Firm* — Rothwell, Figg, Ernst & Manbeck, P.C.

(57) ABSTRACT

An air compressor includes a compression machine configured to generate compression air, a main tank configured to store therein the compression air, an extension tank configured to store therein the compression air, a connection pipeline provided between the main tank and the extension tank to be removably inserted thereto, and a fastening unit configured to releasably connect the main tank and the extension tank with each other.

19 Claims, 16 Drawing Sheets

(56) References Cited

U.S. PATENT DOCUMENTS

| | | | | |
|---|---|---|---|---|
| 2012/0251346 | A1 | 10/2012 | Miura et al. | |
| 2013/0042630 | A1 * | 2/2013 | Muldoon | F02C 7/32 60/796 |
| 2014/0186193 | A1 * | 7/2014 | Yokota | F04B 41/02 417/44.1 |
| 2016/0290329 | A1 | 10/2016 | Hernandez et al. | |

FOREIGN PATENT DOCUMENTS

| | | | | | |
|---|---|---|---|---|---|
| JP | 2013-189897 | A | | 9/2013 | |
| JP | 2013189897 | A | * | 9/2013 | |
| WO | WO-2015175844 | A1 | * | 11/2015 | B60K 15/07 |

OTHER PUBLICATIONS

Office Action issued for corresponding Japanese Application No. 2016-215742 dated Jun. 2, 2020 (10 pages).

* cited by examiner

AIR COMPRESSOR

CROSS-REFERENCE TO RELATED APPLICATION

This application claims priority from Japanese Patent Application No. 2016-215742 filed on Nov. 3, 2016, the entire contents of which are incorporated herein by reference.

TECHNICAL FIELD

Aspects of the present invention relate to an air compressor for construction which is used in construction sites and the like.

BACKGROUND

At construction sites, remodeling sites, and the like, a consumption amount of compression air in construction tools such as a nailer differs greatly depending on an amount of work and a work area. When the amount of work and the work area are large, an auxiliary tank (a compression air storage tank) is added between an air compressor and the tool to increase a capacity of compression air.

For example, it is considered that a main body of the air compressor and the auxiliary tank are connected with each other using a hose, and work is performed by connecting a tool hose to the auxiliary tank.

In this case, the auxiliary tank or the connection hose becomes an obstacle at the work site, which deteriorates work efficiency. This is particularly problematic at a site where the work space is limited as in a remodeling site.

JP-A-2013-189897 discloses an air compressor which is configured such that several extension tanks are integrally combined with a main body of the air compressor. The air compressor shown in FIG. 8 in JP-A-2013-189897 includes three extension tanks.

The extension tank is provided with a tank opening and closing unit (an opening and closing valve) with respect to a main tank. The tank opening and closing value is operated to selectively use a plurality of tanks. In this case, the main tank and the extension tank at the center are used as normal tanks, and the other two tanks are selectively used.

The tank capacity can be adjusted depending on work by providing the opening and closing value between the tanks. However, since the main tank and the extension tank are connected and fixed vertically to each other with a connection unit, the air compressor is carried to the work site in the state of including five tanks and used.

Incidentally, in the air compressor disclosed in JP-A-2013-189897, a metal pipe or the like which has high durability is used as a pipeline which connects the main tank and the extension tank to each other. In a case where the metal pipe is used, since it is difficult to make a connection without any air leakage, the metal pipe is designed such that a user cannot freely connect or disconnect the metal pipe. That is, in order to prevent the air leakage, the air pipeline which connects tanks to each other has a structure that the user cannot easily remove the air pipeline from the tank.

Since the five tanks are always used in a set, when the five tanks are used in the work site where the consumption amount of the compression air is small, the size of the tanks is unnecessarily large.

The occupying place (space) of the main body of the air compressor is not increased so much by connecting the tanks. However, the main body of the air compressor which includes the five tanks has to be always carried to the site, resulting in weight increase all the time.

Accordingly, the present invention has been made in view of the above circumstances, and an object thereof is to provide an air compressor in which a main tank and an extension tank can be separated from each other and attaching and detaching work between the tanks can be performed easily.

According to an aspect of the present invention, there is provided an air compressor including: a compression machine configured to generate compression air; a main tank configured to store therein the compression air; an extension tank configured to store therein the compression air; a connection pipeline provided between the main tank and the extension tank to be removably inserted thereto; and a fastening unit configured to releasably connect the main tank and the extension tank with each other.

In the above air compressor, the connection pipeline may include a hose having flexibility.

In the above air compressor, the fastening unit may be positioned between the main tank and the extension tank.

In the above air compressor, the fastening unit may include an engaging unit attached to the main tank, and an engaged unit provided to the extension tank and configured to be engaged with the engaging unit. The engaging unit and the engaged unit are releasably engaged with each other.

In the above air compressor, the engaged unit may have a box shape which includes a primary side and left and right sides and in which an upper surface and a front surface which face the main tank are open. The engaging unit may be shaped to be engaged with the engaged unit.

In the above air compressor, the engaging unit may include an attachment member provided to the main tank, and a shock absorbing member surrounding the attachment member. The shock absorbing member may be used as a leg portion of a main body of the air compressor.

In the air compressor, the left and right sides of the engaged unit having the box shape may be used as abutting sides to the main tank and also used as leg sides to be fixed to the extension tank.

In the above air compressor, the primary side of the engaged unit may be formed with a screw hole which has a clearance hole for fastening the main tank and the extension tank and with a pair of slits at positions interposing the screw hole.

In the above air compressor, the main tank may be configured with a pair of tanks which are twin tanks.

In the above air compressor, the extension tank may be configured with triple tanks which are connected to each other.

In the above air compressor, the extension tank may include a center tank which is provided with a connection port of the connection pipeline for the compression air in a vicinity of an end portion on a front surface thereof.

According to the above configuration, the air compressor includes a compression machine configured to generate compression air; a main tank configured to store therein the compression air; an extension tank configured to store therein the compression air; a connection pipeline provided between the main tank and the extension tank to be removably inserted thereto; and a fastening unit configured to releasably connect the main tank and the extension tank with each other.

According to the above configurations, since the extension tank is freely attached to and detected from the main tank, the air compressor can be provided which is appropriate for the required amount of compression air depending on construction sites or remodeling sites.

The attaching and the detaching of the extension tank are performed by only inserting and removing of the compression air connection pipe and the attaching and detaching of the fastening unit, and thus the replacement work is simple. Further, since a hose or the like which has high flexibility is used as the connection pipe (the air connection pipeline) for the compression air, efficient procurement and easy handling are achieved.

It is noted that the hose which is mentioned here indicates a pipeline member which has flexibility, and a material thereof is not particularly limited.

Since the engaged unit which includes a primary side having a slit is used as the fastening unit, for example, even in a case where there is small deviation between the engaging unit and the engaged unit, the mechanical deviation between the engaging unit and the female engagement unit can be relatively easily absorbed and the attaching and detaching of the fastening unit can be performed quickly, with the flexibility of the primary side due to the slit and by providing the screw hole with the clearance hole.

Since the shock absorbing member using a rubber material or the like is interposed between the engaging unit and the engaged unit, vibration between the main tank and the extension tank is easily absorbed, and the shock absorbing member is also effective as a countermeasure against noise.

When the air compressor is used in a state where the extension tank is detached, the engaging unit itself functions as a base (a leg), specifically, a rubber foot, of the main body of the air compressor. Accordingly, in addition to the shock absorbing effect with respect to a floor surface, it is advantageous in that work of detaching a constituent member of the engaged unit for storage are unnecessary, and thus an accident, such as loss of the constituent member associated with the storage, can be prevented in advance.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

An air compressor according to an embodiment of the present invention will be described with reference to the drawings. The air compressor supplies compression air (which is called air) necessary to drive tools, such as a nailer, which are used in work sites, such as construction sites and remodeling sites.

Figure 1:
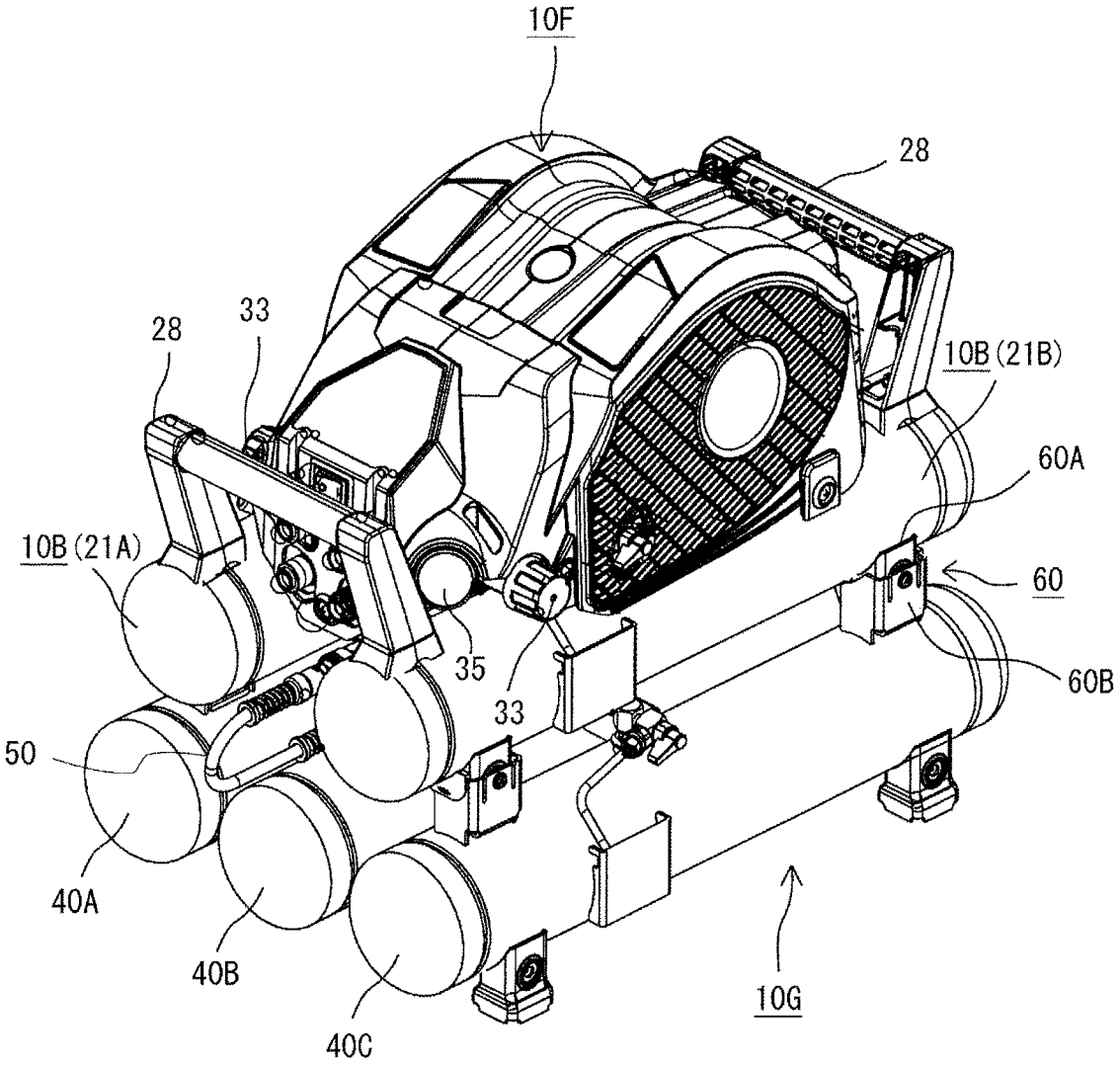
FIG. 1 is a perspective view illustrating an air compressor according to an embodiment of the present invention.
Figure 2:
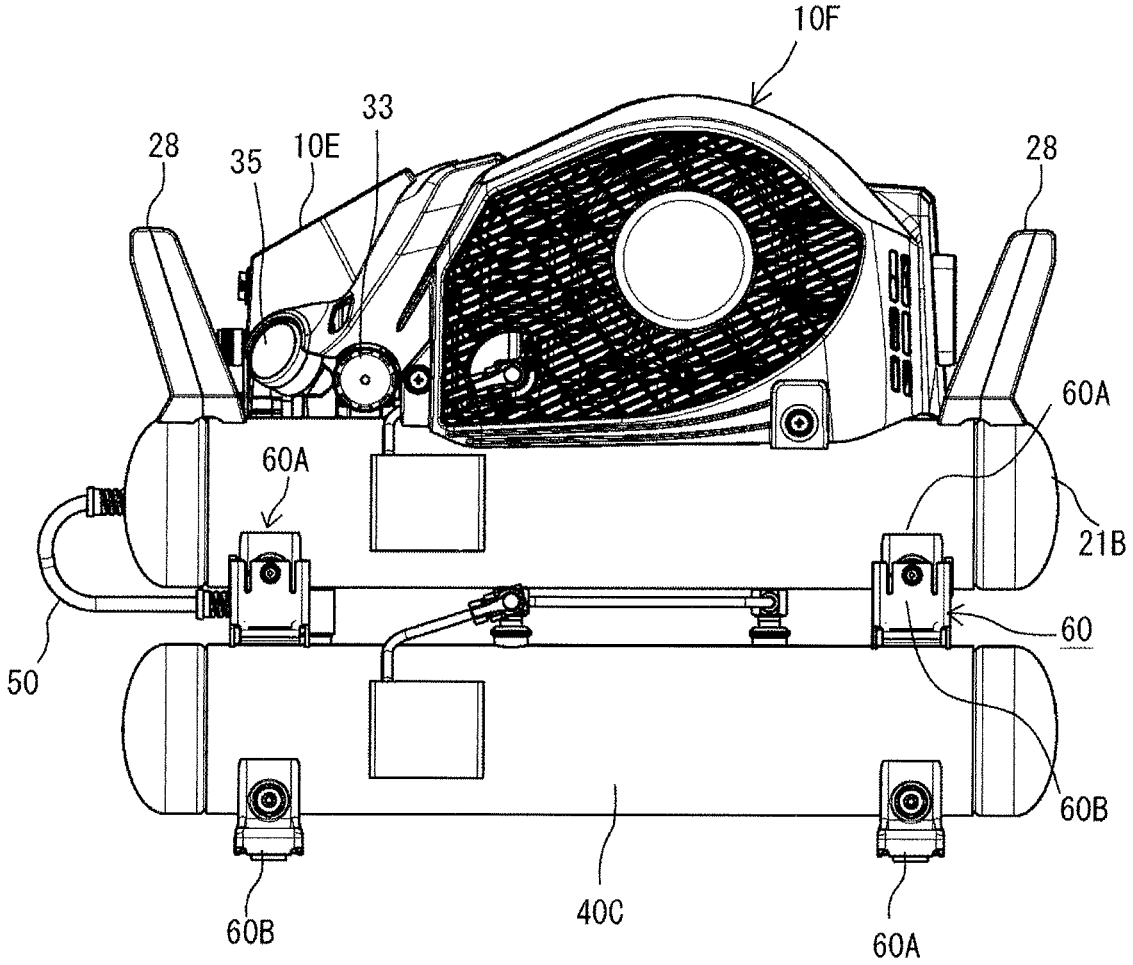
FIG. 2 is a right side view of the air compressor.
Figure 3:
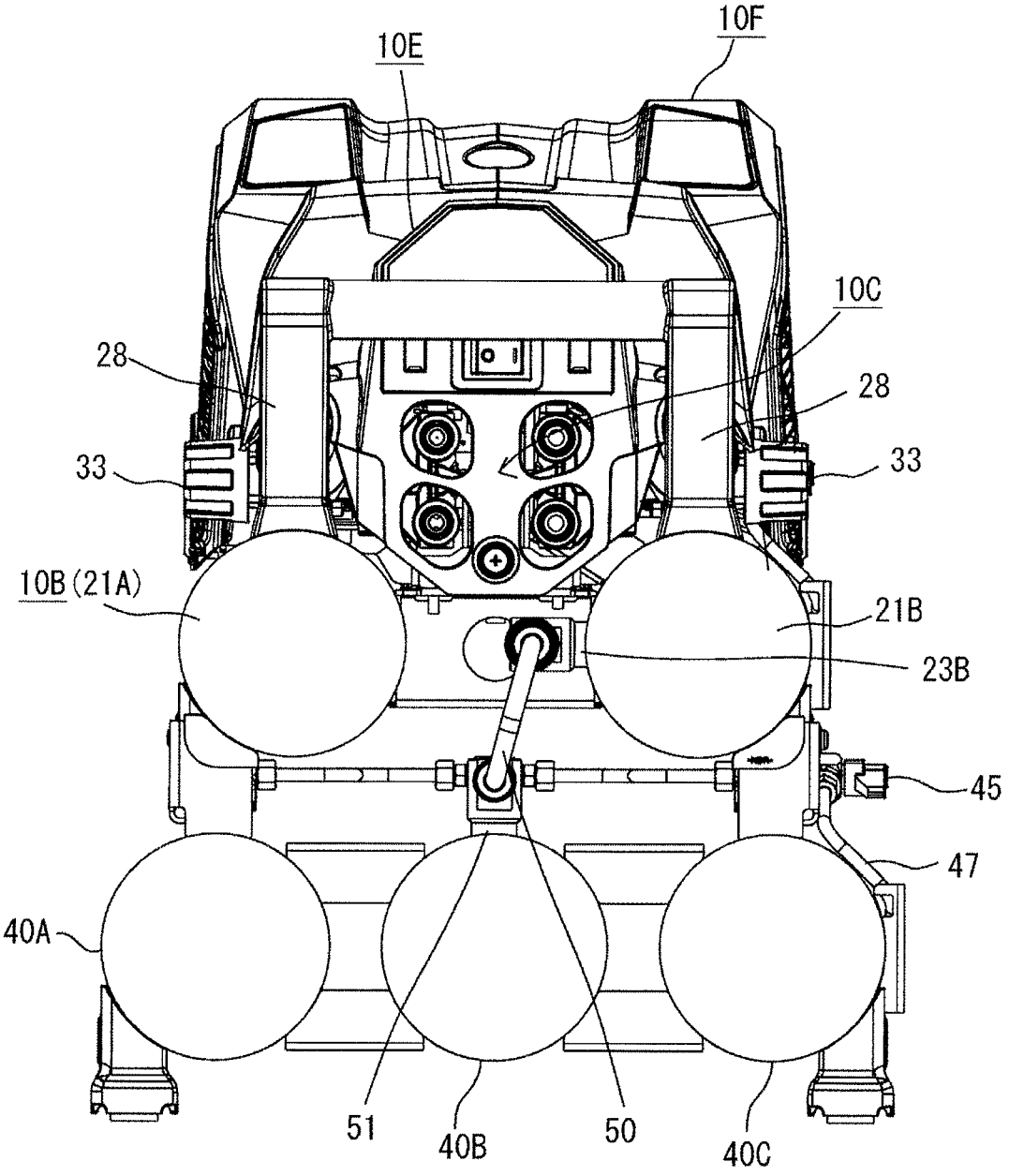
FIG. 3 is a front view of the air compressor.
Figure 4:
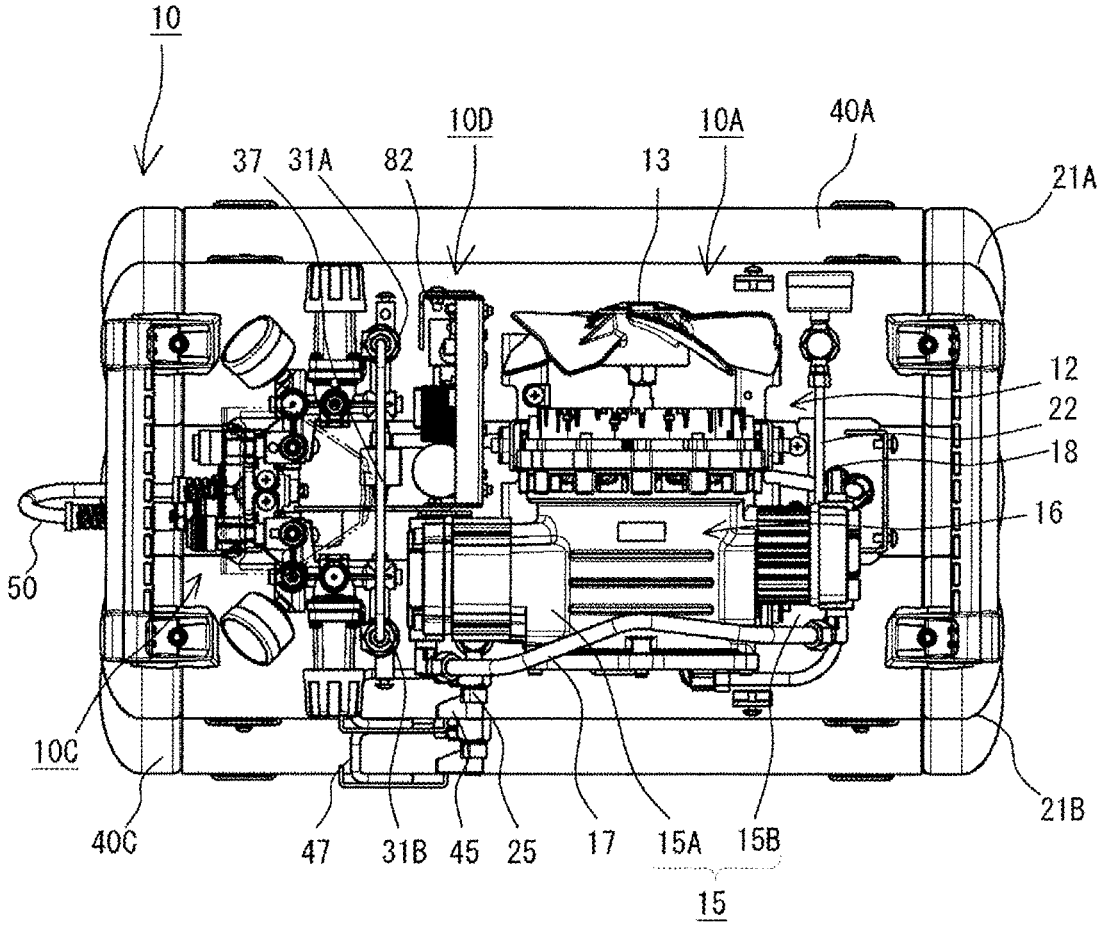
FIG. 4 is a top view of the air compressor in a state where a cover is detached.
Figure 5:
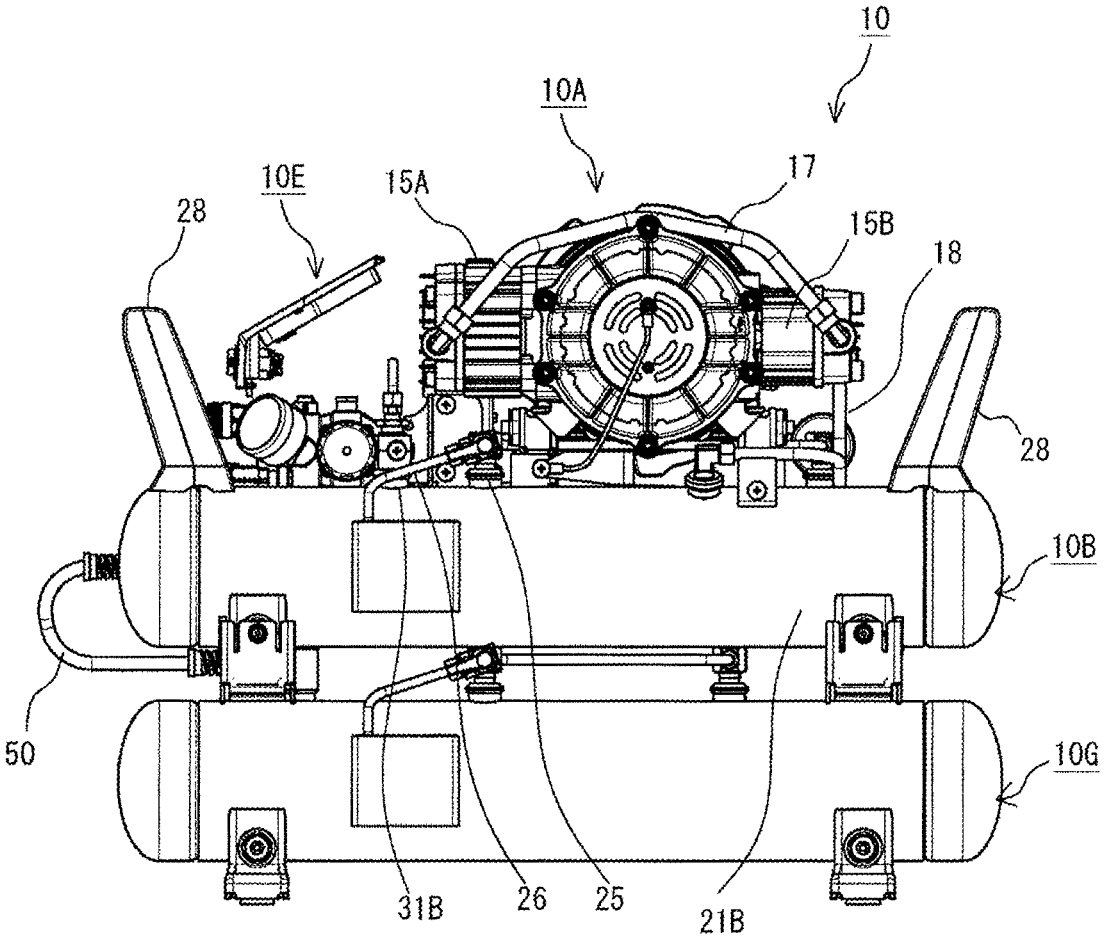
FIG. 5 is a right side view of the air compressor in the state where the cover is detached.
Figure 6:
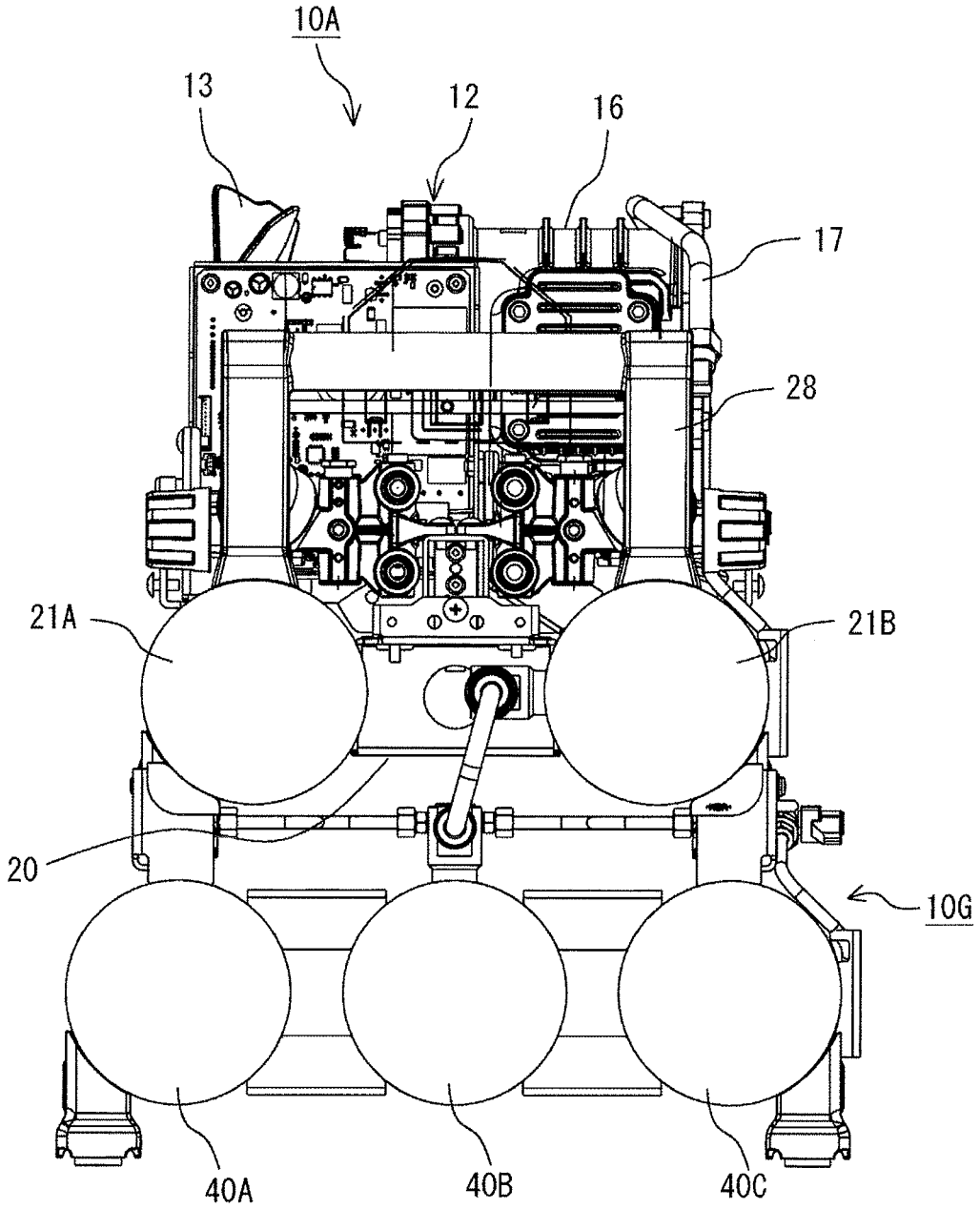
FIG. 6 is a front view of the air compressor in the state where the cover is detached.

FIGS. 1 to 3 are views illustrating an entire configuration of an air compressor 10 in a state where a cover main body is mounted. Specifically, FIG. 1 is a perspective view, FIG. 2 is a top view, and FIG. 3 is a front view. FIGS. 4 to 6 are views illustrating the air compressor 10 in a state where the cover main body is detached. Specifically, FIG. 4 is a top view, FIG. 5 is a right side view, and FIG. 6 is a front view.

With reference to FIGS. 4 to 6, the air compressor 10 includes a compression machine 10A, a tank unit (a main tank) 10B which not only supports the compression machine 10A but also stores compression air, an air extraction unit 10C which extracts the compression air from the main tank 10B, a circuit board (an inverter board) 10D which motor-drives the compression machine 10A, an operation unit 10E which controls the compression machine 10A, and a main body cover 10F (FIG. 1). Further, the air compressor 10 includes an extension tank 10G which is detachably attached to the main tank 10B. A main body of the air compressor 10 includes the compression machine 10A and the main tank 10B.

Configuration of Compression Machine 10A

As illustrated in FIGS. 4 to 6, the compression machine 10A includes a compression motor 12, a cooling fan 13 is attached to a rotation shaft (a motor axis) (not shown) thereof, and a compression cylinder 15 is placed on the motor axis side which is opposite to the cooling fan 13.

In this embodiment, the cylinder 15 has a two-layer compression structure which includes a primary cylinder 15A and a secondary cylinder 15B. As illustrated in FIG. 4, the cylinder 15 is placed in the horizontal direction which is orthogonal to the motor axis. In order to compress air in the cylinder 15, a piston drive unit (not shown) which connects the motor axis and a piston (not shown) of each of the primary and secondary cylinder 15A and 15B is connected to the motor axis within a crankcase 16, drives a piston by rotation of a motor 12, and thus compresses the air within the cylinder 15. Since the piston drive unit is connected directly to the motor axis, the motor 12, the crankcase 16, and the cylinder 15 are integrated.

The compressed air which results from the compression within the primary cylinder 15A is sent into the secondary cylinder 15B through an air connection pipe 17 which is installed to straddle the crankcase 16, is further compressed at high pressure in the second cylinder 15B, and is sent into the main tank 10B, which in this embodiment is a right-side tank 21B, through an air connection pipe 18 (FIG. 5).

Relationship Between Motor and Tank

The compression machine 10A is attached to an upper portion of the main tank 10B. When a length (a length of a cylinder shaft) from the primary cylinder 15A to the secondary cylinder 15B is longer than a length (a length of the motor axis) of the compression machine 10A which includes the cooling fan 13, the cylinder shaft, as illustrated in FIG. 4, is in parallel to the tank axis, and the compression machine 10A is mounted such that the motor axis is in parallel to the tank axis. This is to prevent the mounted compression machine from protruding from a side surface of the main tank 10B even in a case where the air compressor 10 is size-reduced.

The compression machine 10A is attached to the upper portion of the main tank 10B. Although not shown, the compression machine 10 is fixed to the main tank 10B using a metal clasp (a male side) which is connected to each of the tanks 21A and 21B and a metal fitting (a female side) which is connected to the compression machine 10A.

In this case, although a shock absorbing material (a rubber material or the like) is interposed between the compression machine 10A and the main tank 10B, the compression machine 10A is loosely engaged to be movable. With this movement, vibration of the compression machine 10A is difficult to propagate to the main tank 10B side.

The main tank 10B illustrated in FIG. 6 includes a pair of the tanks 21A and 21B which have a length and diameter to store a predetermined amount of air. The tanks 21A and 21B are fixedly attached to configure twin tanks with a predetermined pitch (a tank pitch) in between. In this embodiment, as illustrated in FIG. 6, a connection plate body 20 is welded to the tanks 21A and 21B to be fixed.

On a rear end portion side upper surface of the main tank 10B, a drain pipeline 22 is connected between the left tank 21A and the right tank 21B along a lower portion of the secondary cylinder 15B. Since the drain pipeline 22 discharges water which stays on in the internal bottom of the tank, a water output pipe (not shown) is vertically installed within a tank pipe of each of the tanks.

On the front surface side of the right tank 21B, a drain cock 25 is installed on the front surface side of the right tank 21B and a pipe surface which faces the vicinity of a lower surface of the secondary cylinder 15B. With a drain connection pipeline (not shown), the drain cock 25 is connected to the drain pipeline 22 on the rear side. As illustrated in FIG. 5, a connection pipe 26 for draining water from the drain cock 25 is provided on a side surface of the right tank 21B. However, this piping for the drain connection and the discharging is merely an example.

Relationship in Attachment Position Between Compression Machine and Tank

The compression machine 10A is mounted on a rear end side of the main tank 10B (a right end side in the drawing), and therefore, a space, as illustrated in FIGS. 4 and 5, is secured for attaching various members to a front end upper portion of the tank. The various members include the air extraction unit 10C and an inverter board 10D for the compressor, as will be described in detail below. The space is an attachment space for an operation unit 10E for operating the compression machine 10A.

Air Extraction Unit

The air extraction unit 10C is a member for extracting stored air from the tank and supplying the stored air to a tool. A primary pressure pipeline 32A which constitutes one portion of the air extraction unit 10C is connected to tank connection ports 31A and 31B which are provided in the front end upper surface sides (the top sides), respectively. The air is guided, through the primary pressure pipeline 32A and a secondary pressure pipeline 32B which will be described below, up to air extraction openings (air chucks 38A and 38B) which are terminals thereof, and the air is supplied to the tool (such as the nailer), through a hose which is inserted into the air extraction openings 38A and 38B.

Positional Relationship Between Air Extraction Unit and Tank

A pair of the air extraction units 10 are attached to upper portion of the left tank 21A and the right tank 21B respectively at a posture that the air extraction units 10C are both laid on their sides such that the air extraction units 10C are positioned close to the center surface of the main body but do not protrude excessively from an upper surface of the tank.

The air extraction unit 10C of the left tank 21A and the air extraction unit 10C of the right tank 21B are arranged close to the center of the main body of the air compressor, and an air extraction opening 38 which is provided on the air extraction unit 10C is positioned within a space where the tanks 21A and 21B face each other. Consequently, when the air extraction opening 38 is configured in a branching manner as illustrated in the drawing, it is preferable that at least the air extraction opening 38B provided downward is positioned in the vicinity (which includes a point above, on, and below a tangential line) of a tangential line which connects points at which a vertical axis passing the center of each of the tanks 21A and 21B and a circumference surface intersect.

Since the air extraction units 10C and 10C are arranged close to the center of the main body of the air compressor, the air extraction opening 38, as illustrated in FIG. 1, can be viewed from between legs of a handle 28, and a tool hose is inserted through between the handle 28 (between the legs). Accordingly, an amount of protrusion of the tool hose from the main body of the compressor to the outside can be reduced. Accordingly, it is possible that the air compressor is arranged in a space of short distance, and the compressor can be used in an environment where other items for constructions are placed adjacently. Further, even when a small operation space is available in a site, an operation can be performed without interference with other construction devices. The handle 28 is a member which is gripped to carry the air compressor 10.

Configuration of Air Extraction Unit

The air extraction unit 10C is configured such that a height, a width and a depth are as small as possible so that the air extraction unit 10C is not only positioned close to the center of the main body of the air compressor, but can also occupy less space in a state of being attached to the main body.

Figure 7:
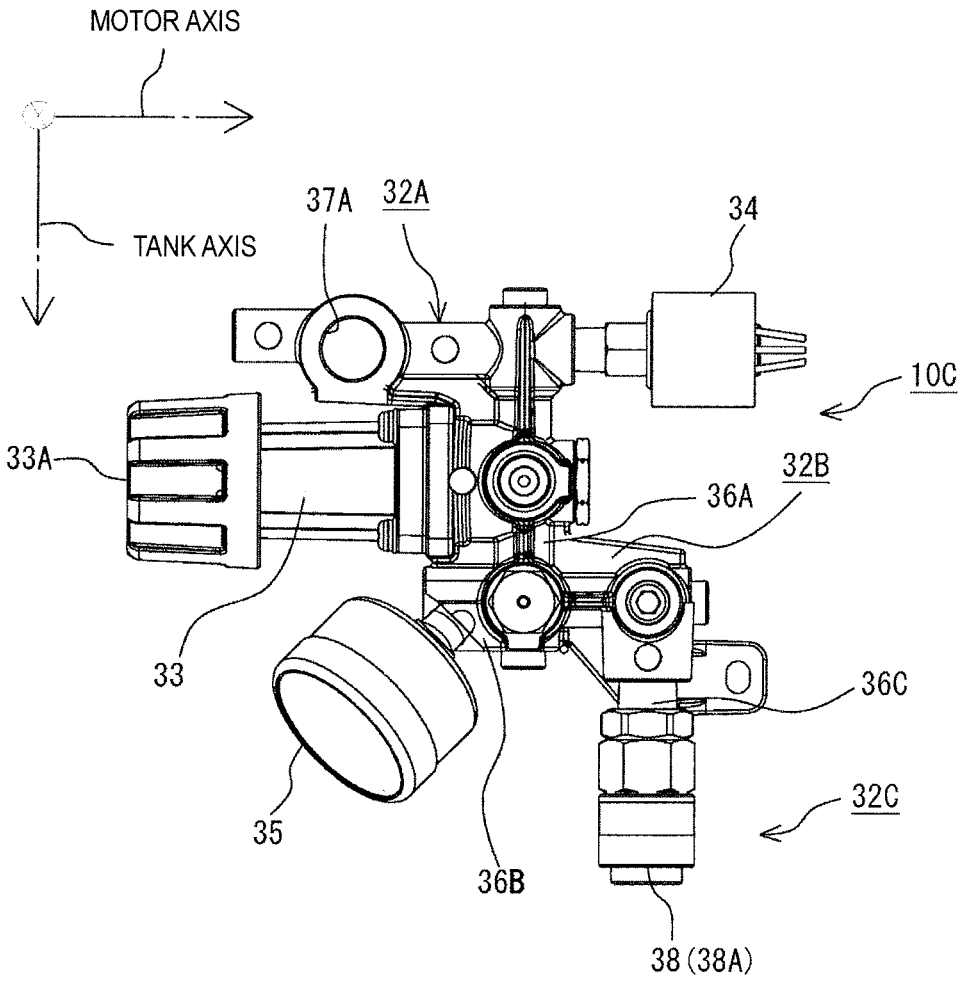
FIG. 7 is a top view of an air extraction unit in an attached state.
Figure 8:
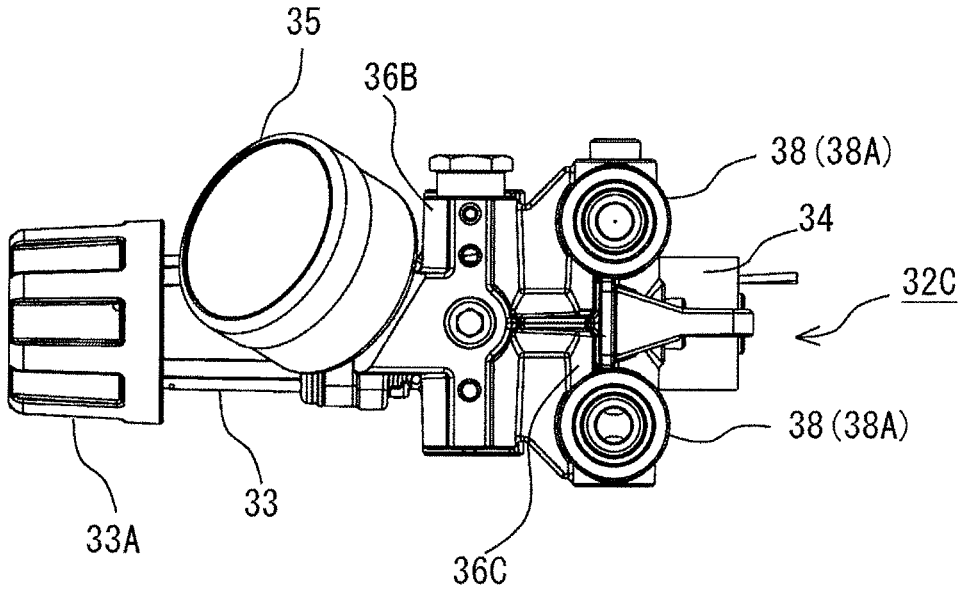
FIG. 8 is a front view of the air extraction unit.
Figure 9:
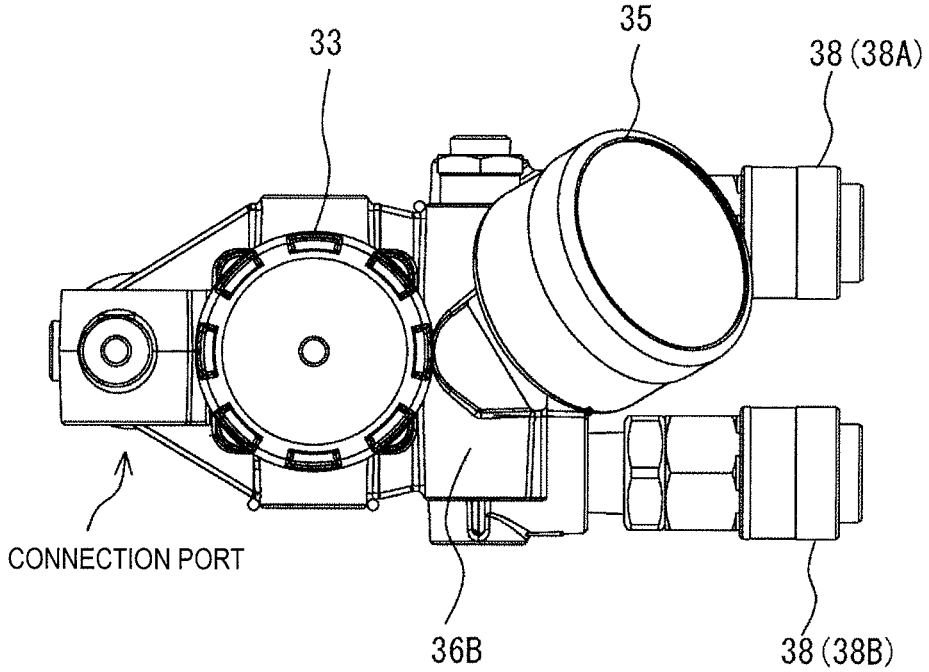
FIG. 9 is a left side view of the air extraction unit.

FIG. 7 illustrates a specific example. FIG. 7 is a top view of the air extraction unit 10C in a state of being attached to the main tank 10B. FIG. 8 is a front view (a front view of the man body of the compressor). FIG. 9 is a left side view (a side of the left tank 21A).

The air extraction unit 10C includes the primary pressure pipeline 32A, the secondary pressure pipeline 32B which communicates with the primary pressure pipeline 32A, and the air extraction opening (the air chuck) 38. Since the air extraction units 10C which are attached to the tanks 21A and 21B, respectively, are horizontally symmetrical, only the air extraction unit 10C which is attached to the left tank 21A will be described.

The air extraction unit 10C has the T-shaped primary pressure pipeline 32A which rises more upward (in the direction of the compressor) than a connection port (not shown) which is formed at a predetermined position in the front surface side upper surface of the left tank 21A, and then faces the center of the main body of the compressor.

A pressure sensor 34 which detects pressure within the tank is attached to an extension end of a pipeline 32A which extends in parallel to the motor axis, in the primary pressure pipeline 32A. A pressure reducing valve 33 is attached to a pipeline 32B which is orthogonal to the motor axis and extends in parallel to the tank axis. The reference numeral 33A denotes an operation unit (gripping unit) for pressure adjustment.

An air connection port 37A (refer to FIG. 7) is formed in an upper portion which extends to a tank connection port, of the pipeline 32A which constitutes the primary pressure pipeline 32A. Air connection ports in the air extraction unit 10C are connected with an air connection pipe 37 (FIG. 4). Accordingly, air which is stored in the pair of tanks 21A and 21B is in a state of communicating with each other. A connection portion of the air connection pipe 37 is provided on the primary pressure pipeline 32A, and thus, the air connection pipe 37 can be installed in a space (a space over the primary pressure pipeline 32A) over the air extraction unit 10C.

The pressure reducing valve 33 is configured to arbitrarily adjust pressure of air which is extracted from the tanks 21A and 21B. Accordingly, the pressure of the air which is discharged from the tank can be arbitrarily adjusted. For example, when pressure for extracting from a left-side extraction opening is set to be room pressure, pressure for extracting from a right-side extraction opening can be adjusted to be high pressure. This is because in some cases, air discharge pressure required for a type of tool which is connected to the air extraction opening 38 (38A and 38B) varies.

The pressure reducing valve 33 is positioned within a plane which is defined by two axes, i.e. the motor axis and an axis which is orthogonal to each of the motor axis and the tank axis of the compression machine 10A. In FIG. 6, the pressure reducing valve 33 is attached to have an angle of 0° with respect to the motor axis. Therefore, the pressure reducing valve 33 extends in parallel to a horizontal axis of the motor axis, in other words, a horizontal axis of the main tank 10B.

Primary pressure is adjusted with the pressure reducing valve 33 to be secondary pressure (output pressure), and the secondary pressure flows into the secondary pressure pipeline 32B.

The secondary pressure pipeline 32B is a crank-shaped pipeline. As illustrated, a pressure gauge 35 is connected to a bent end portion 36B of the pipeline 36A which extends in parallel to the tank axis. With the pressure gauge 35, the secondary pressure can be confirmed.

The pressure gauge 35 is positioned within a plane which is surrounded by three axes, i.e. an axis which is orthogonal to each of the motor axis and the tank axis, the motor axis, and the tank axis.

Within a plane which is surrounded by these three axes in FIGS. 7 to 9, the pressure gauge 35 is attached to be inclined by an angle range of 20° to 30° with respect to each of the motor axis and the tank axis and to face toward the obliquely upward direction.

Since the pressure gauge 35 is attached in an inclined manner, even though the pressure gauge 35 is placed in close proximity to the pressure reducing valve 33, the pressure reducing valve 33 can be operated without interference of the pressure gauge 33. Further, a display surface of the pressure gauge 35 faces toward the obliquely upward direction, so that dust can be prevented from attaching on the display surface and being accumulated.

A front end portion of a pipeline 36C which extends in parallel to the tank axis, which is bent in the shape of a crank though a pipeline which extends in parallel to the motor axis and is continuous to the pipeline 36A, is the air extraction opening 38 which has an air chuck function.

The air extraction opening 38 is vertically divided into two parts. In this embodiment, the air extraction opening 38A in the upward side is a socket with purge, and the air extraction opening 38A in the downward side is a normal socket.

Accordingly, the pair of air extraction units 10C extend substantially in parallel to a horizontal line (the motor axis) which connects top surfaces of the left and right tanks 21A and 21B. Moreover, both of the air extraction units 10C are arranged to be close to the main body center surface side. Therefore, the air extraction unit 10C can be reduced in height, width, and length.

In addition, a tool hose can be detachably attached to the air extraction opening 38 without interfering with the handle 28. Since the pressure reducing valve 33 is arranged in parallel to the motor axis between the handle 28 and the tank connection port 31A, pressure can be easily adjusted. Since the pressure gauge 35 is obliquely arranged, dust can slide off the display surface. Thus, the display surface can be easily viewed.

It is noted that in a case where the air extraction opening which is positioned downward is attached to face the outside (in the obliquely outward direction) not in parallel to the tank axis as disclosed in JP-A-2013-189897, for example, when the tool hose is attached to the air extraction opening, since the tool hose is spread in the V shape when viewed from above, an area which is occupied by a place where the main body of the air compressor is placed is increased.

Configuration of Extension Tank

Figure 10:
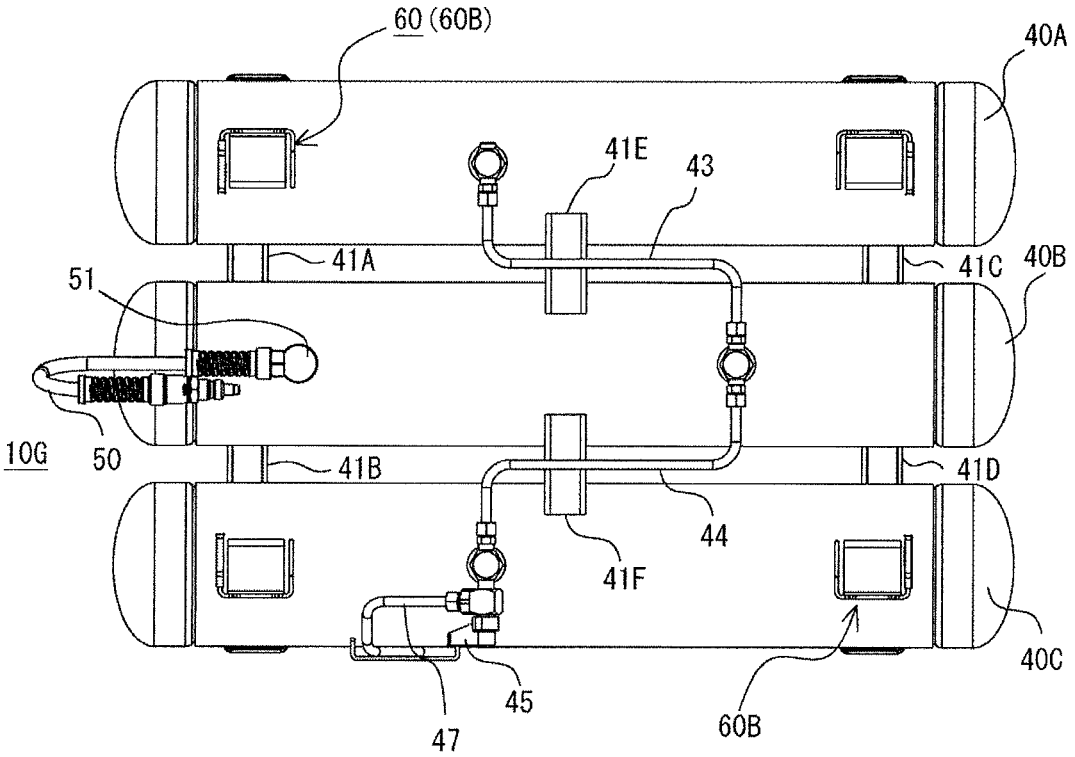
FIG. 10 is a top view illustrating an example of an extension tank.
Figure 11:
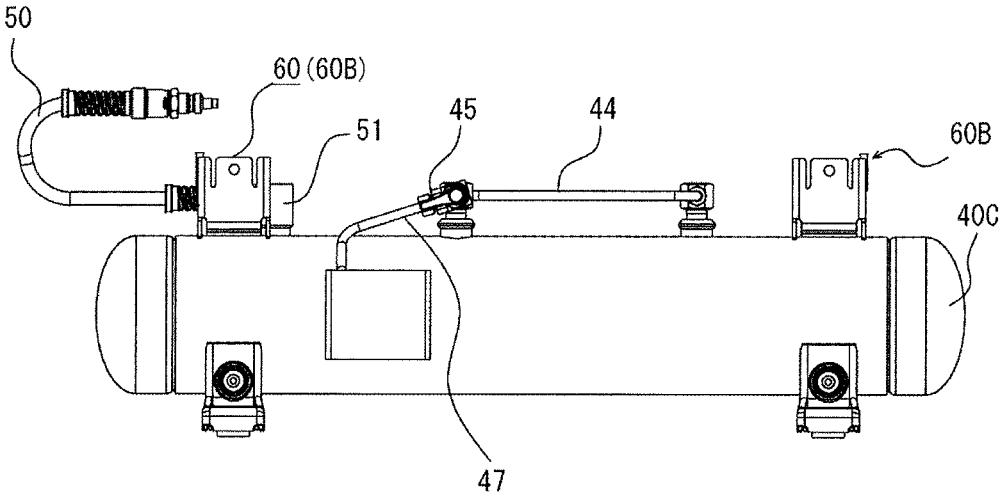
FIG. 11 is a right side view of the extension tank.
Figure 12:
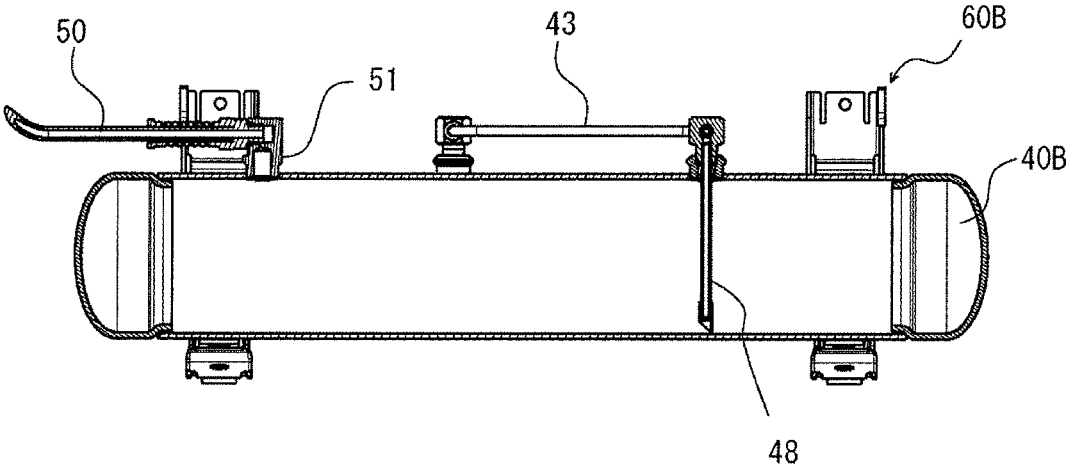
FIG. 12 is a vertical cross-sectional view of a center tank of the extension tank.

FIGS. 10 to 12 illustrate an example of an extension tank 10G. FIG. 10 is a top view of the extension tank 10G. FIG. 11 is a right side view of the extension tank 10G. FIG. 12 is a vertical cross-sectional view of a center of the extension tank 10G.

The extension tank 10G includes a plurality of tanks. In this example, the extension tank 10G is a triple type which includes three tanks 40A to 40C. Each of the tanks 40A to 40C is fixed to each other at equal distances in a state where predetermined pitches between the tanks 40A to 40C are maintained with a plurality of connections plates 41A to 41F provided on the front and rear sides.

A pipeline 43 is connected between an upper surface of substantially center of the left tank 40A and an upper surface of the rear end of the center tank 40B. Similarly, a pipeline 44 is connected between the upper surface of the rear end of the center tank 40B and an upper surface of substantially center of the right tanks 40C. The pipelines 43 and 44 function not only as air connection lines but also as drain connection pipelines. Therefore, a drain cock 45 is provided on a pipeline end portion of the right tank 40C, and a drain pipe 47 is connected to the drain cock 45. A water discharge pipe 48 is vertically installed in each of the tanks 40A to 40C (only the center tank 40B is illustrated in FIG. 12). In order to provide an air connection to the main tank 10B, a connection port 51 is formed on the upper surface side of the front end of the center tank 40B, to which an air connection pipe 50 is removably inserted. As a connection portion which is provided on an end portion of the air connection pipe 50, a one touch-type coupler or the like is used in order to facilitate attaching and detaching (inserting and removing) operation.

The air connection pipe 50 is a pipe body which has flexibility. As illustrated in the drawings, the air connection pipe 50 may be an air connection pipe which has high flexibility, such as a rubber hose. The air connection pipe 50 has a length which can be connected to a connection port 23B which is provided in a side surface of one of the main tank 10B, which is the left tank 21B in this example as illustrated in FIG. 3. Specifically, the air connection pipe 50 has a length which does not cause an obstacle in attaching and detaching the tool hose.

A connection portion which is provided on an end portion of the air connection pipe 50 may be one touch-type coupler which is easy in detaching and attaching (insert and remove) operation, or the like. In a case where the one touch-type coupler is used, it is preferable that a lock-equipped coupler is used in order to be prevented from dropping down. An orifice (aperture) may be provided to suppress air from being discharged from the tank, or a coupler with purge may be used.

In one embodiment, one end portion of the air connection pipe 50 may be fixed to the extension tank 40B, and other end portion of the air connection pipe 50 may be detachably attached to the connection port 23B of the main tank 10B by one touch-type coupler.

Fastening Unit

In the vicinity of each of the front and rear end portions of the left and right tanks 40A and 40C, a fastening unit 60 for attaching and detaching the extension tank 10G to and from the main tank 10B is provided on an upper surface of each of the left and right tanks 40A and 40C.

Figure 13:
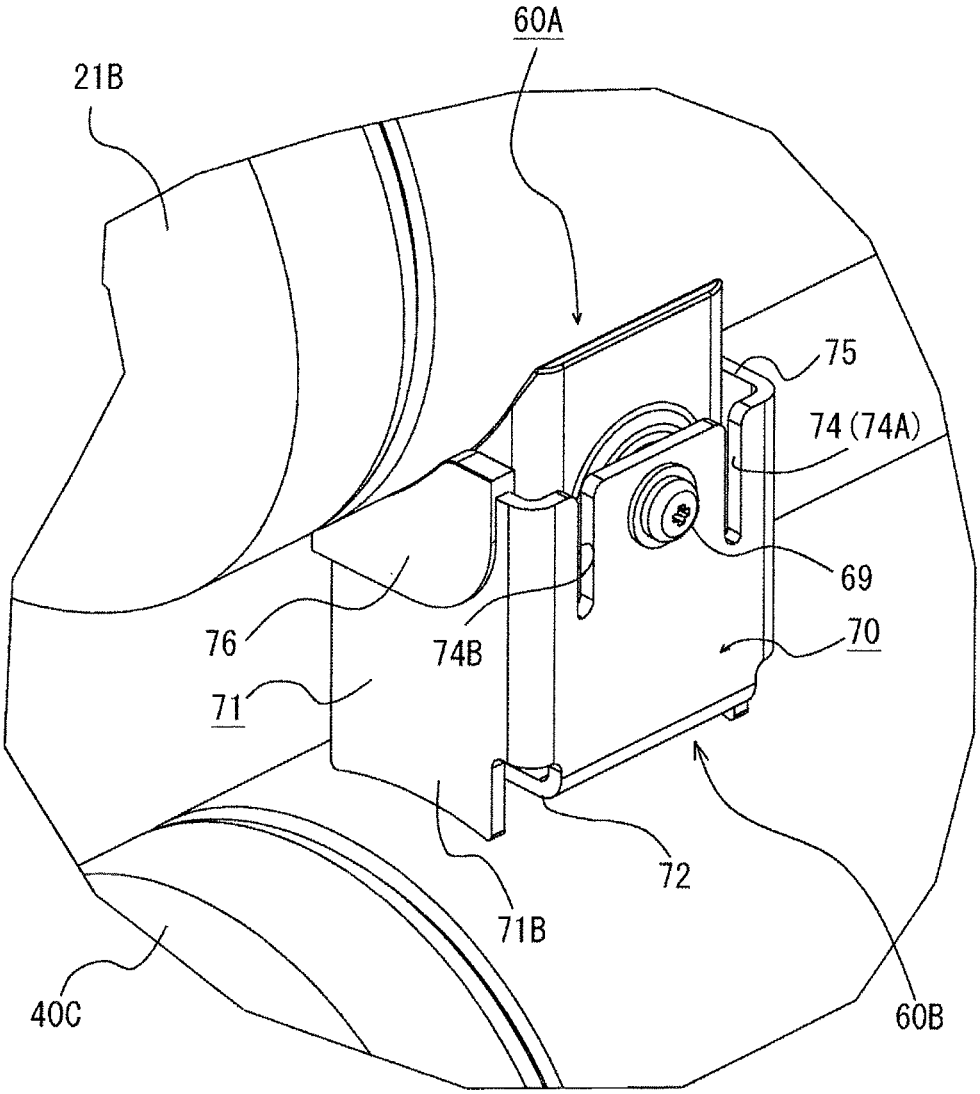
FIG. 13 is a perspective view of an example of a fastening unit in a used state.

An example of the fastening unit 60 will be described with reference to FIGS. 13 to 15. The fastening unit 60 is configured with an engaging unit 60A and an engaged unit 60B. FIG. 13 is a perspective view of the fastening unit 60 in which screwing is performed in a state where the engaging unit 60A which is provided on the right tank 21B is engaged with the engaged unit 60B which is provided on the extension tank 10G. The engaging unit 60A is provided on a lower and side surface of the right tank 21B, and the engaged unit 60B is provided on an upper surface center portion of the right tank 40C of the extension tank 10G.

Figure 14:
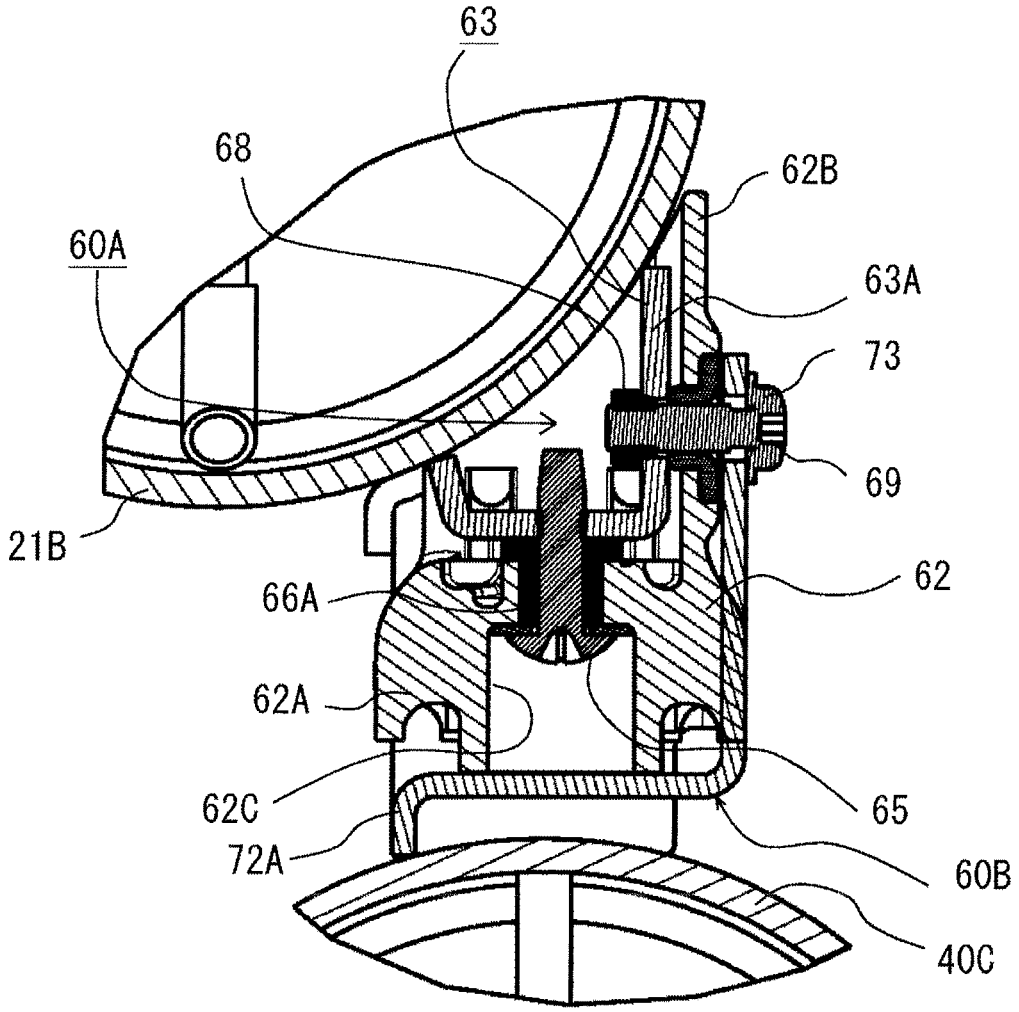
FIG. 14 is a vertical cross-sectional view of the fastening unit.
Figure 15:
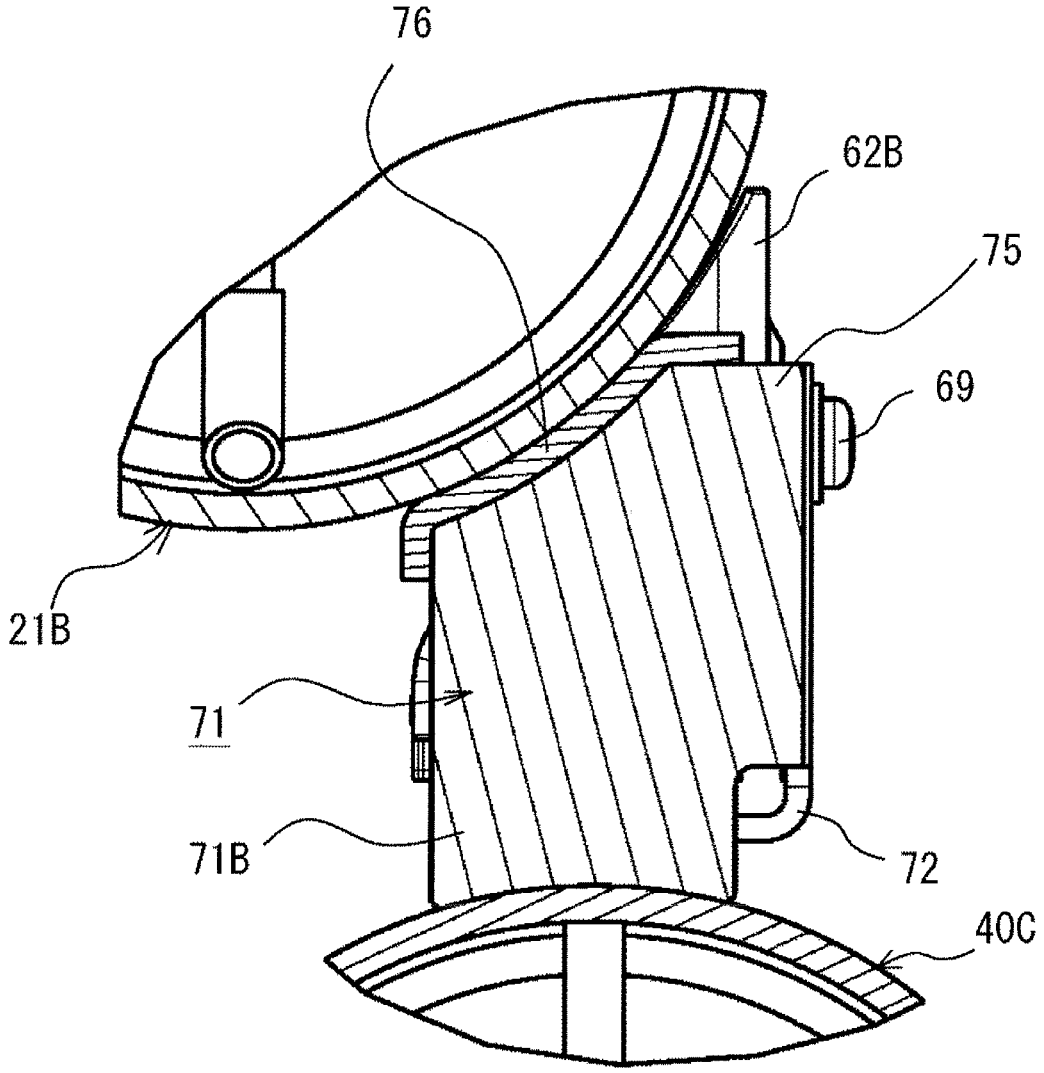
FIG. 15 is a vertical cross-sectional view of a left side which configures an engaging unit.

As illustrated in FIG. 14, the engaging unit 60A includes a shock absorbing member 62 which has a shock absorbing function and is used as a base (a leg portion) when only the right tank 21B is used, and an attachment member 63 for the shock absorbing member 62. The shock absorbing member 62 functions as a rubber material foot when only the main tank 10B is used.

The attachment member 63 is formed by a metal plate which has J-shape in a cross section and is welded to the right tank 21B, and the shock absorbing member 62 is fixedly attached to surround the attachment member 63.

The shock absorbing member 62 is formed by a rubber material or the like which has high flexibility. The shock absorbing member 62 includes a thick bottom portion 62A and an upright piece 62B. A tightening screw (in this example, a tapping screw) 65 is fastened, through a washer 66A with flange, to the attachment member 63, from a cavity 62C in the thick bottom portion 62A.

A nut 68 is press-fitted from the inside in the vicinity of a center portion of a side surface plate 63A of the attachment member 63, and the press-fitted nut 68 is fastened from the upright piece 62B side with a screw 69. Thus, the shock absorbing member 62 and the attachment member 63 are mutually fastened.

The tapping screw is used as the tightening screw 65 because the shock absorbing member 62 and the attachment member 63 are designed not to be separated after being connected to each other.

The engaged unit 60B is a connection plate which has a primary side 70 and left and right sides 71 and in which an upper side and a front side are open as illustrated in FIG. 13, so as to have a box shape which has a depth and a width same as an engaging depth and width of the engaging unit 60A which is a base.

Upper surfaces of the left and right sides 71 are used as a peripheral surface contact portion (an abutting side) of the right tank 21B, and lower surfaces thereof are used as a leg portion (a leg side) 71B which is fixed to the right tank 40C. The left and right sides 71 are separated by a bottom side 72, and the bottom side 72 is bent to the right tank 40C such that only a front end portion 72A thereof comes into contact with the right tank 40C. Accordingly, the left and right sides 71 and the front end portion 72A (FIG. 14) of the bottom side are welded to the right tank 40C so that the engaged unit 60B is fixed. Since only the left and right sides 71 and the front end portion 72A are connected, the engaged unit 60B can be fixed to the extension tank 10G more efficiently compared with a case where the entire bottom side is welded and obtain some damper effects.

A center upper portion of the primary side 70A is formed with a screw hole 73 for fastening, which has a clearance hole for fastening the right tank 21B and the extension tank 10G, and a pair of slits 74 (74A and 74B) at positions the screw hole 73.

Since the formation of the slits 74 makes the primary side 70 to have some flexibility, an attachment error (tolerance) between the engaging unit 60A and the engaged unit 60B can be absorbed by the slits 74 and the screw hole 73 which has the clearance hole. Accordingly, the attaching and the detaching are made easy.

The left and right sides 71 have curves surfaces along an abutting surface of the tank, and a cap 76 which is also used as a cushion is mounted on a peripheral surface contact portion 75. Accordingly, impact on the right tank 21B of the engaged unit 60B can be easily absorbed.

Figure 16:
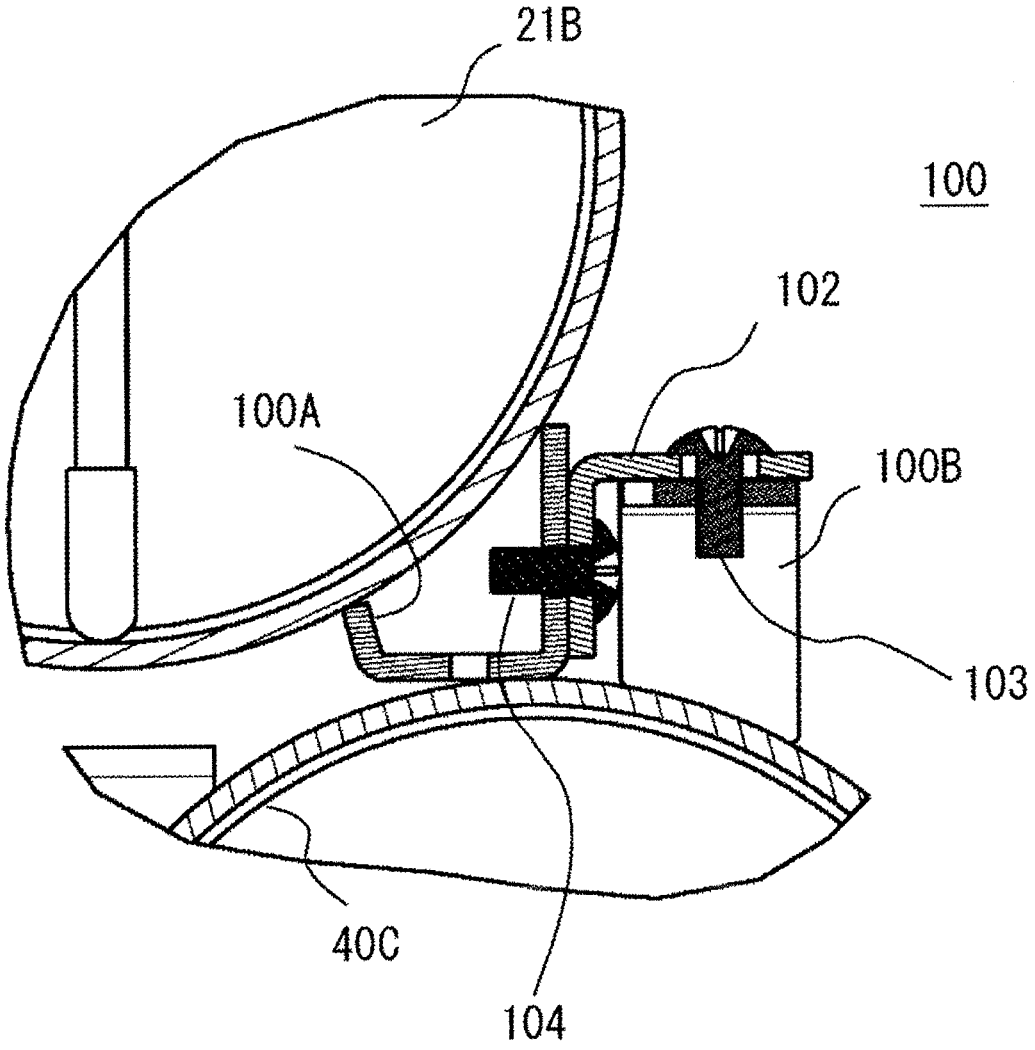
FIG. 16 is a vertical cross-sectional view of an example of a related-art fastening unit.

As the related-art fastening unit, an engaging unit 100 (a reference example) which employs a configuration as illustrated in FIG. 16 is known. The engaging unit 100 is a simplified version and includes an engaging piece 100A and an engaged piece 100B to which the engaging piece 100A is attached, with reference to the above-described embodiment. The engaging piece 100A is formed by a shaped plate which has a J-shape in a vertical cross section. The engaging piece 100A is joined to a lower surface side portion of the tank 21B by welding or the like. The engaged piece 100B is formed by a shaped plate which has an almost gate-shaped cross section (the shape of a symbol it), and both leg portions thereof are joined to the vicinity of an upper surface center portion of the right tank 40C by welding or the like.

The engaged piece 100B is fixedly attached to the engaging piece 100A with a screw 103 and the like through an intermediate plate 102 which has a L-shape. The intermediate plate 102 is attached, by the screw 103 in the upward direction, from an upper surface of the engaged piece 100B, and the intermediate plate 102 and the engaging piece 100A is fixedly attached, by a screw 104 in the downward direction, to a side surface of the engaging piece 100A.

The related-art engaging unit 100 allows the extension tank 10G to be detached from the main tank 10B by detaching two screws, the screws 103 and 104. However, in a case where the extension tank 10G is detached, attachments components, such as the intermediate plate 102, in addition to two screws, the screws 103 and 104 have to be stored, and when an operation of attaching the tank is performed in a site and the like, the attachment component is easy to be lost and the storing and managing of the attachment components are considerably troublesome. In this respect, in the case of the above-described embodiment, since the screw 69 can be kept fixed to the engaged unit 60B, the storing and managing of the attachment components are not necessary.

The intermediate plate 102 in which a clearance hole is formed in order to absorb deviation which is generated between the engaging piece 100A and the engaged piece 100B is not used, and thus in a case where the deviation is generated, it is difficult to reliably perform the fastening. However, the pair of slits 74 (74A and 74B) which are formed at positions to interpose the screw hole 73 make the primary side 70 to have some flexibility, so that the slits 74 and the screw hole 73 with the clearance hole leads to absorbing the deviation (tolerance) in a joining portion. Therefore, small deviation can be allowed as in the related art.

Coupler for Air Connection Pipe

As described above, in a case where the air connection pipe 50 as the air connection pipeline is configured to be freely attachable and detachable, air leakage has to be set not to occur in a joining portion between the main tank 10B and the air connection pipe 50.

Figure 17A:
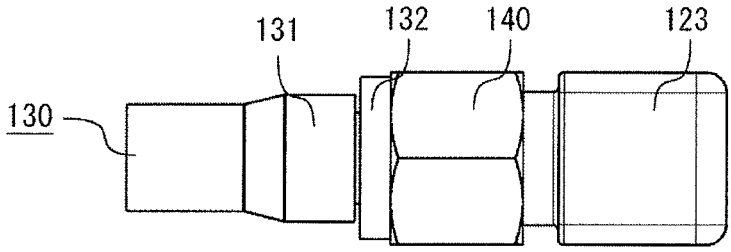
FIGS. 17A to 17C are views illustrating an example of a connection unit which can be used for an air connection pipe.
Figure 17B:
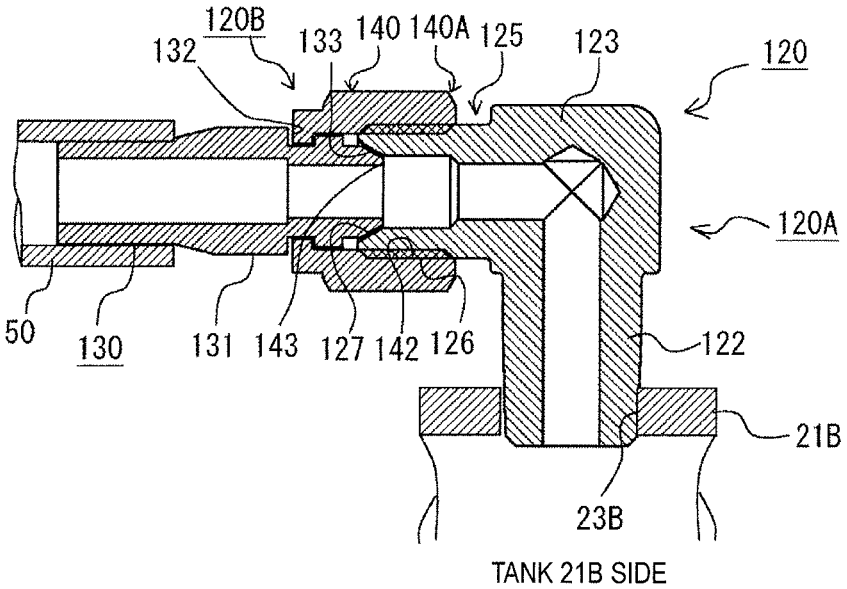
Figure 17C:
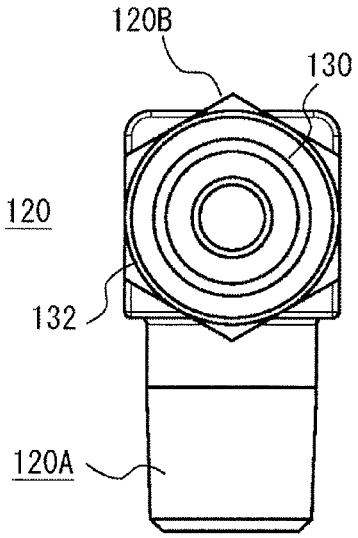

FIGS. 17A to 17C illustrate an example of a connection unit (coupler) 120, by which a concern with the leakage does not occur using a method other than the one-touch coupler. FIG. 17A is an enlarged top view illustrating the coupling unit. FIG. 17B is a vertical cross-sectional view illustrating the coupling unit. FIG. 17C is a front view illustrating the coupling unit.

The connection unit 120, as illustrated in FIG. 17B, is configured with a coupler 120A which is joined to the tank 40C, and a coupler 120B which is provided on the air connection pipe 50.

The tank side coupler 120A is a coupler which is made of metal, and one end 122 thereof is fixedly screwed into the connection port 23B in the tank 21B. A front end side of the other end 123 is used as a joining portion 125. A male screw 126 is formed close to a front end of the joining portion 125, and a joining taper 127 (a female type taper) is formed in an inner surface of the front end portion thereof.

The coupler 120B which is provided on the air connection pipe 50 has an engaging portion (a pipe body which is made of metal) 130 which is engaged with a front end portion of the air connection pipe 50, and one end of the engaging portion 130 is a large-diameter portion 131.

A ring-shaped groove 132 which has a predetermined inner diameter and width is formed at some distance in the forward direction from a front end of the large-diameter portion 131, and a joining taper (the female type taper) 133, which comes into contact with the joining taper 127 of the tank side coupler 120A, is formed in a front end portion 143 than the ring-shaped groove 132.

A joining screw 140 which is engaged to cover a front end portion of the large-diameter portion 131 is provided on the coupler 120B. Since the joining screw 140 is connected with one coupler 120A to join (fix) the one coupler 120A and the other coupler 120B to each other, the joining screw 140 is used which has such a long length to protrude by a predetermined length from the front end portion of the grate-diameter portion 131 such that the joining screw 140 can reach the joining unit 125. A female screw 142 meshing with the male screw 126 is threaded on the inner surface of a front end portion 140A of the joining screw 140.

In the connection unit 120 with this configuration, in a case where the couplers 120A and 120B are connected to each other, the joining screw 140 is tightened to engage the male screw 126 with the female screw 142, and to bring the joining taper 133 into contact with the joining taper 127, and then the joining screw 140 is rotated until both are tightly contacted to each other. With this tight contact, the coupler 120B on the air connection pipe 50 tightly contacts to the coupler 120A on the tank in a reliably fixed manner. As a result, although required air protrusion pressure is added into the air connection pipe 50, there is no concern that the air leakage from the connection unit 120 will occur.

Figure 18A:
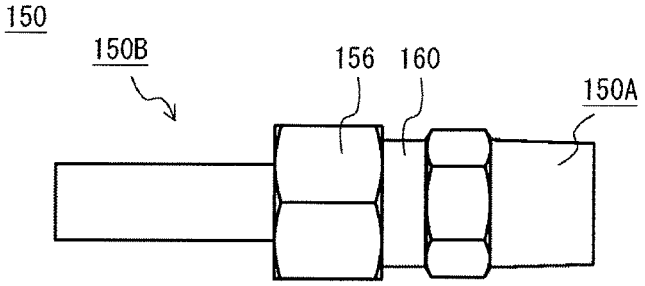
FIGS. 18A to 18C are views illustrating an example of a related-art connection unit.
Figure 18C:
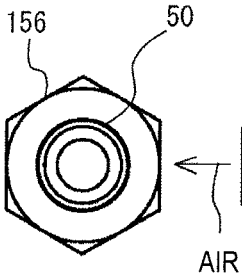
Figure 18B:
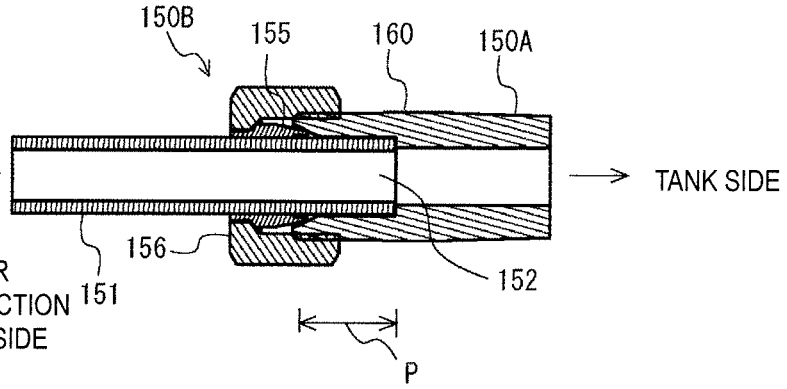

Incidentally, in the related art, a connection unit 150 which is of a connection type as illustrated in FIGS. 18A to 18C is used. The connection unit 150 is configured only with a joining portion 160 which has the shape of a straight pipe as a tank side coupler 150A. A coupler 150B for the air connection pipe 50 is formed by a pipe body 151 which has the shape of a straight pipe. A front end 152 of the pipe body 151 is configured to be inserted only by a predetermined length P into a pipe of the coupler 150A.

A wedge-shaped bush 155 is set in at a length p in the forward direction from a front end 152 of the pipe body 151, and a joining screw 156 is engaged with the outside of the bush 155 to press-insert the bush 155.

The joining screw 156 is configured to be able to be engaged with a male screw that results from threading an external circumference of an end surface of the joining unit 160.

In a state where the pipe body 151 is inserted into the joining portion 160, when the joining screw 156 is caused to be engaged with a screw portion which is formed in the outside of the joining portion 160 and is tightened, the bush 155 is deformed while tightly contact to an inside taper portion of the joining screw 156 and a taper portion of a front end of the joining portion 160 to follow the shape of the taper portion. Since the bush 155 is deformed in order for the pipe body 151 to tightly contact at the same time, sealing can be reliably performed.

In this configuration, tightening torque of the coupler 150B is important. A problem does not occur particularly when assembling is performed in a factory, but when a user attaches or detaches the connection unit 150, in a case where torque is insufficient, the air leakage cannot be prevented with this configuration. Conversely, when the tightening is performed with excessive torque, the pipe body 151 is deformed, and after all, there is a concern that the sealing will not be able to be reliably performed.

In contrast, with the configuration in FIGS. 17A to 17C, only with the tightening of the joining screw 140, the tapers 127 and 142 tightly contact to each other, and thus the coupler 120B can be connected to the coupler 120A. Accordingly, torque is easy to control at the time of the tightening, and although the attaching and detaching of the connection unit 120 are repeated, there is no concern that the sealing will be incompletely performed.

Since a member which is deformed at the time of the tightening is not used, seal efficiency can be secured without depending on the torque at the time of the tightening, and at the same time, tightening torque is easy to control. The above-described coupling structure is an example of the connection unit. As described above, the user has difficulty in performing a connection between the pipeline and the coupler, but if a configuration is employed in which the coupler which is already attached to the pipe body and the coupler which is provided on the tank side are connected to each other, since the pipeline is easy to attach and detach, a connection pipeline member to which the coupler is in advance attached may be used.

Position of Inverter

An inverter board (a board for an inverter) 10D is used in order to drive a compression motor 12, and as illustrated in FIG. 4, has a configuration in which a plurality of circuit elements, such as a coil and a capacitor, are mounted on a board having a rectangular shape.

On an upper surface of the main tank 10B, the inverter board 10D is attached within a space which is present between the compression motor 12 and the primary cylinder 15A. The inverter board 10D is installed upright on a concatenation member (not shown) to which the main tank 10B is attached, to extend in parallel to the motor axis through an auxiliary member 82.

When the inverter board 10D is smaller in height than the compression motor 12 or the crankcase 16 and moreover, when the inverter board 10D is installed upright, the thickness of the inverter board 10D is set such that a circuit element on the inverter board 10D is not superimposed on the air extraction unit 10C.

A surface (a rear surface) of the inverter board 10D which is opposite to a surface of the inverter board 10D on which the circuit element is mounted, is positioned to face the cooling fan 13 and thus the inverter board can be efficiently cooled.

Position of Operation Unit

The operation unit 10E which controls the main body of the air compressor is positioned within a space over an upper surface of the air extraction unit 10C. A power switch or the like is positioned in the operation unit 10E, and additionally, a display component, such as a display indicator, is additionally installed. The operation unit 10E is attached at an inclination angle in order not to protrude from an external surface of the main body cover 10F which will be described below.

Main Body Cover

Since the main body cover 10F, as illustrated in FIG. 1, covers the compression machine 10A and the like which are arranged on an upper portion of the main tank 10B, the main body cover 10F is formed into a shape which follows an external shape of (outer shapes of the compression motor 12, and the primary and secondary cylinders 15A and 15B) of the compression machine 10A while keeping these members separated some distance from each other such that vibration of the compression machine can be absorbed. A distance between lower end portions of both flank surface of the main body cover 10F is set to be extremely small in order to protect a user from a rotation unit or an electric circuit unit.

A front surface of the main body cover 10F, more precisely, a front surface of the main body of the air compressor, is inclined in an oblique manner in the forward direction, but a portion which faces the operation unit 10E is an opening portion through which the operation unit is exposed.

As illustrated in FIG. 1, the main body cover 10F which corresponds to a position under both sides of the operation unit 10E has an opening, and accordingly, the pressure reducing valve 33, the pressure gauge 35, and the air extraction unit 10C, which are described above, are exposed to the outside. Thus, operativity and visibility are secured.

Size-Reduction of Compressor

In positioning the compression machine 10A on the upper portion of the main tank 10B, a positional relationship in which size-reduction can be achieved is selected without the compression machine 10A protruding from an outer edge of the main tank 10B, and the air extraction unit 10C is positioned to be brought close to the center of the main body of the compressor while is shortened. The height, the width, and the depth of the air compressor is made as small as possible. Accordingly, the size of the air compressor can be reduced.

In addition to these configurations, a configuration is employed in which the drain pipeline is installed in a space between the secondary cylinder 15B and the main tank 10B, in which the drain cock 25 is positioned on the upper surface side of the main tank 10B that is brought close to the primary cylinder 15A, and in which the inverter board 10D is positioned in a space between the motor 12 and the primary cylinder 15A and is installed upright particularly to be in parallel to the motor axis. For this reason, a space over the upper portion side of the main tank 10B can be effectively used. Accordingly, a tank length or a tank pitch can be shortened, and thus the size of the air compressor 10 can be further reduced.

An embodiment in which the main tank is configured with two cylindrical tanks is described above, but it is noted that the present invention can also be applied to a case where only one tank is set to store air, and the other tank is used as a container or the like, or to an air compressor in which the main tank is configured with three or more tanks.

The present invention is applicable in an air compressor for construction which is used in work sites, such as various construction sites and remodeling sites.

What is claimed is:

1. An air compressor comprising:

a compression machine configured to generate compression air;

a main tank configured to store therein the compression air;

an extension tank configured to store therein the compression air;

a connection pipeline provided between the main tank and the extension tank to be removably inserted thereto; and a fastening unit configured to releasably connect the main tank and the extension tank with each other, wherein the connection pipeline includes a hose having flexibility, wherein the fastening unit includes:

an engaging unit attached to the main tank; and an engaged unit provided to the extension tank and configured to be engaged with the engaging unit and, wherein the engaging unit and the engaged unit are releasably engaged with each other, and wherein the engaging unit includes:

art attachment member provided to the main tank; and a shock absorbing member surrounding the attachment member, with at least a portion of the shock absorbing member between the attachment member and the engaged unit, wherein the shock absorbing member forms a leg portion of a main body of the air compressor, wherein the main tank and the extension tank are connected by the fastening unit and through the shock absorbing member, and wherein a primary side of the engaged unit is formed with a screw hole which has a clearance hole for fastening the main tank and the extension tank and with a pair of slits at positions interposing the screw hole.

2. The air compressor according to claim 1, wherein the engaged unit has a box shape which includes a primary side and left and right sides, and wherein an upper side and a front side of the engaged unit which face the main tank are open to an interior of the engaged unit between the primary side and the left and right sides, and wherein the engaging unit is shaped to be engaged with the engaged unit.

3. The air compressor according to claim 1, wherein a left side and a right side of the engaged unit have a box shape and provide abutting sides to the main tank and also provide leg sides to be fixed to the extension tank.

4. The air compressor according to claim 1, wherein the main tank is configured with a pair of tanks which are twin tanks.

5. The air compressor according to claim 1, wherein the extension tank is configured with triple tanks which are connected to each other.

6. The air compressor according to claim 5, wherein the extension tank includes a center tank which is provided with a connection port of the connection pipeline for the compression air in an area of an end portion on a front surface thereof.

7. The air compressor according to claim 1, wherein the main tank is provided with an attachment unit for attaching the compression machine at an upper portion thereof and is provided with the engaging unit for fastening the extension tank to the main tank at a lower portion thereof.

8. The air compressor according to claim 1, wherein the main tank is mounted to the extension tank so as to overlap with each other in an upper-lower direction.

9. The air compressor according to claim 1, wherein the shock absorbing member is at least partially positioned inside the engaged unit.

10. The air compressor according to claim 9, wherein a screw extends through the engaged unit, through the shock absorbing member and through the attachment member.

11. The air compressor according to claim 9, wherein an upright piece of the shock absorbing member extends upwardly above the engaged unit.

12. An air compressor comprising:

a compression machine configured to generate compression air;

a main tank configured to store therein the compression air;

an extension tank configured to store therein the compression air;

a connection pipeline provided between the main tank and the extension tank to be removably inserted thereto; and a fastening unit configured to releasably connect the main tank and the extension tank with each other, wherein the connection pipeline includes a hose having flexibility, wherein the fastening unit includes:

an engaging unit attached to the main tank; and an engaged unit provided to the extension tank and configured to be engaged with the engaging unit, wherein the engaging unit and the engaged unit are releasably engaged with each other, wherein the engaging unit includes:

an attachment member provided to the main tank; and a shock absorbing member surrounding the attachment member, with at least a portion of the shock absorbing member between the attachment member and the engaged unit, wherein the shock absorbing member forms a leg portion of a main body of the air compressor, wherein the main tank and the extension tank are connected by the fastening unit and through the shock absorbing member, wherein the shock absorbing member is at least partially positioned inside the engaged unit, wherein a screw extends through the engaged unit, through the shock absorbing member and through the attachment member, and wherein another screw extends from an interior of the engaged unit through the shock absorbing member and through the attachment member.

13. The air compressor according to claim 12, wherein the engaged unit has a box shape which includes a primary side and left and right sides, and wherein an upper side and a front side of the engaged unit which face the main tank are open to an interior of the engaged unit between the primary side and the left and right sides, and wherein the engaging unit is shaped to be engaged with the engaged unit.

14. The air compressor according to claim 12, wherein a left side and a right side of the engaged unit have a box shape and provide abutting sides to the main tank and also provide leg sides to be fixed to the extension tank.

15. The air compressor according to claim 12, wherein the shock absorbing member is positioned within the fastening unit.

16. The air compressor according to claim 12, wherein the shock absorbing member includes an opening, and a portion of the fastening unit extends through the opening.

17. The air compressor according to claim 12, wherein with the engaging unit attached to the main tank and the engaged unit engaged with the engaging unit:

the engaged unit includes a bottom side portion and a primary side portion extending upwardly from the bottom side portion, the shock absorbing member includes a bottom portion and an upright piece extending upwardly from the bottom portion, the bottom portion of the shock absorbing member is positioned between the bottom side portion of the engaged gnat mitt the attachment member of the engaging unit, and the upright piece of the shock absorbing member is positioned between the primary side portion of the engaged unit and the attachment member of the engaging unit.

18. The air compressor according to claim 12, wherein a first fastener fastens the shock absorbing member and the attachment member together; and a second fastener fastens each of the engaged unit, the shock absorbing member and the attachment member together.

19. The air compressor according to claim 18, wherein in the state in which the extension tank is detached, the main tank is supported by the shock absorbing member connected to the attachment member by way of the first fastener.

* * * * *